US005825332A

United States Patent [19]

Camacho et al.

[11] Patent Number: 5,825,332

[45] Date of Patent: Oct. 20, 1998

[54] MULTIFUNCTION STRUCTURALLY INTEGRATED VHF-UHF AIRCRAFT ANTENNA SYSTEM

[75] Inventors: Gerardo I. Camacho; Donn V. Campbell, both of Poway, Calif.

[73] Assignee: TRW Inc., Redondo Beach, Calif.

[21] Appl. No.: 712,686

[22] Filed: Sep. 12, 1996

[51] Int. Cl.[6] ..... H01Q 1/28; H01Q 13/10

[52] U.S. Cl. ..... 343/708; 343/767; 343/770

[58] Field of Search ..... 343/708, 705, 343/767, 770; H01Q 1/28, 13/10

[56] References Cited

U.S. PATENT DOCUMENTS

| | | | |
|---|---|---|---|
| 2,701,307 | 2/1955 | Cary | 343/708 |
| 2,781,512 | 2/1957 | Robinson, Jr. | 343/708 |
| 2,908,000 | 10/1959 | Robinson, Jr. | 343/708 |
| 3,086,204 | 4/1963 | Alford | 343/708 |

*Primary Examiner*—Hoanganh T. Le
*Attorney, Agent, or Firm*—Michael S. Yatsko

[57] ABSTRACT

An antenna system utilizing an electrically conductive portion (16) of an aircraft structure to radiate and receive very-high-frequency (VHF) and ultra-high-frequency (UHF) radio signals over a wide frequency range without the need for an active tuner to accommodate frequency changes. An antenna element (22) is housed in a tail fin endcap section (20) and is positioned and shaped to form an elongated notch (26) between one edge (24) of the element itself and one adjacent edge (18) of an electrically conductive tail fin (16). The notch (26) is uniform over part of its length and is flared to a wider spacing over the remainder of its length. A feed point (30) along the notch (26) is selected for optimum performance. Matching electronics (14) couple the antenna system to a transceiver (15), which can operate either in a VHF/FM band, or in a UHF band, or in a VHF/AM band. The antenna system provides relatively good gain over the frequency range and provides a practically omnidirectional radiation pattern.

6 Claims, 7 Drawing Sheets

FREQUENCY 30.0 TO 90.0 MHz

MULTIFUNCTION STRUCTURALLY INTEGRATED VHF-UHF AIRCRAFT ANTENNA SYSTEM

BACKGROUND OF THE INVENTION

This invention relates generally to aircraft antenna systems and, more particularly, to aircraft antenna systems capable of supporting operation in the very-high-frequency (VHF) and ultra-high-frequency (UHF) ranges. Modern aircraft, particularly military aircraft, have a need to provide radio communication over a variety of frequency ranges and communication modes. For example, communications may be needed in a VHF band using frequency modulation (FM), in a VHF band using amplitude modulation (AM), and in a UHF band. Of these functions, the most difficult to achieve efficiently is operation in the lower frequency VHF/FM band, e.g. in the range 30–88 MHz, having wavelengths in the range of approximately 3–10 meters. For most efficient operation, antennas have dimensions in the same order of magnitude as the wavelengths of the signals being propagated. A classical dipole antenna, for example, is one-half wavelength ($\lambda/2$) in total length. Antenna that are much smaller than this are referred to as "electrically small." If electrically small antennas are used for operation in the 30–88 MHz frequency band, for example, they must be appropriately matched to radio transmitters and receivers using impedance matching networks.

A further difficulty in the design of aircraft antennas is that some communication applications call for frequency "hopping," i.e., rapidly switching from one carrier frequency to another within the same band, principally for security reasons. Therefore, a high-speed active tuner is needed to continually modify the matching network as the transmission frequency is changed. Tuners of this type are relatively costly and unreliable, and are generally incapable of tracking the frequency changes needed in a frequency hopping communication system. Prior to this invention, communication in the VHF/FM mode has been achieved using an electrically small blade antenna, i.e., a fin protruding from the surface of the aircraft, and high speed electronics for synchronously tuning the antenna. Broadband, electrically small VHF/FM blade antennas have a very low gain because of their poor matching network efficiency and small radiation resistance. Further, blade antennas do not couple radio frequency (rf) current to the aircraft skin effectively. Coupling rf signals to conductive portions of the aircraft is a technique that has been used in other contexts when the only available antenna elements were electrically small in relation to the wavelengths of the signals being transmitted and received.

Because they protrude from the aircraft, blade antennas adversely affect aircraft aerodynamics. Typical solutions prior to this invention require the use of multiple blade antennas, one for VHF/FM applications, another for VHF/AM and another for UHF communication. Obviously, this solution has an even greater adverse impact on aircraft aerodynamics.

Ideally, what is needed is a single broadband antenna that can be operated efficiently over a wide frequency range. More specifically, the single antenna should be capable of operating in a frequency-hopping mode in the VHF/FM band without the need for an active tuning device, and should also be capable of operating in higher frequency bands, such as VHF/AM and UHF. The present invention satisfies these requirements.

SUMMARY OF THE INVENTION

The present invention resides in a multifunction notch antenna system designed to be totally integrated within an aircraft, the antenna system providing for operation over a wide range of frequencies, including a VHF/FM band in a frequency-hopping mode, without the need for active tuning devices.

Briefly, and in general terms, the antenna system of the invention comprises an electrically conductive portion of an aircraft structure; and an antenna element positioned and shaped to form a non-conductive notch between the antenna element and the electrically conductive portion of the aircraft structure. The notch is generally uniform in width over part of its length and flares to a larger width over the remainder of its length. The antenna system further comprises broadband impedance matching electronics, designated the AMU (antenna matching unit) in this specification for coupling the antenna system to a transceiver, and for matching the impedance of the antenna system with the impedance of the transceiver to provide efficient transfer of energy to and from the antenna; and an antenna feed for connection from the matching electronics to opposite sides of the notch at a selected antenna feed point, to excite the antenna for transmission of signals and to conduct received signals from the antenna element and electrically conductive portion of the aircraft structure. The electrically conductive portion of the aircraft structure functions as a radiating or receiving component of the antenna system, which can be easily matched with transceiver equipment operating over a wide range of frequencies. In the disclosed embodiment of the invention, the electrically conductive portion of the aircraft structure includes a tail fin of the aircraft, and the antenna element is housed within a tail fin endcap. By way of example, the antenna system operates at a very-high-frequency (VHF) band in the range of approximately 30–88 MHz, as well as at higher frequencies in an ultra-high-frequency (UHF) band, and without the need for active tuner components.

It will be appreciated from the foregoing that the present invention provides a significant advance in the field of aircraft antennas. In particular, the invention provides for antenna operation either in the VHF/FM band or in higher frequency bands, without the need for active tuners. Other aspects and advantages of the invention will become apparent from the following more detailed description, taken in conjunction with the accompanying drawings, which are briefly described below.

DESCRIPTION OF THE PREFERRED EMBODIMENT

Figure 1:
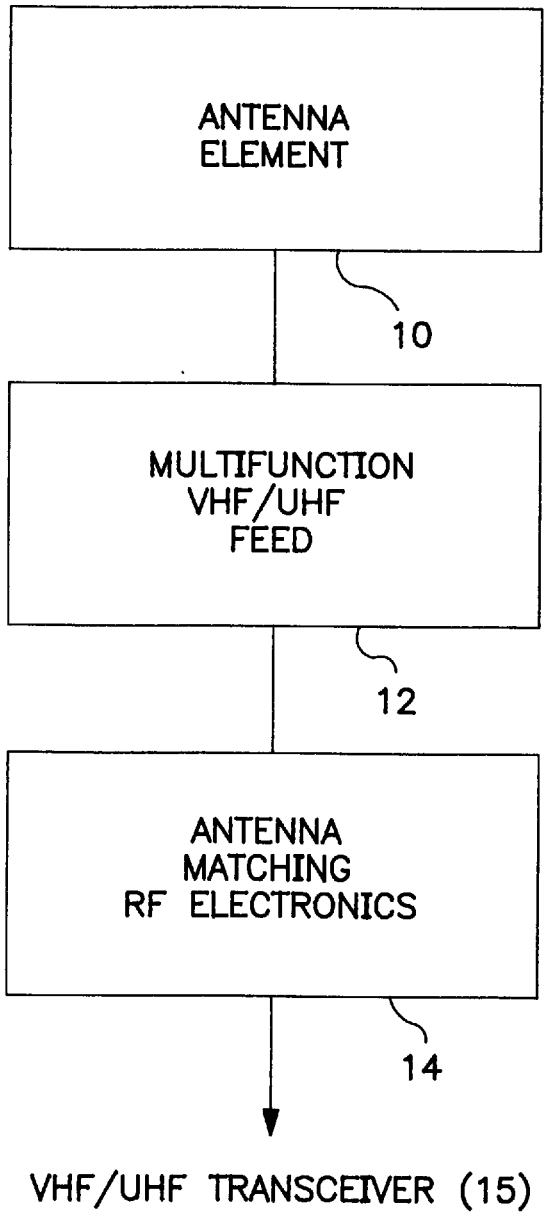
FIG. 1 is a block diagram showing the three principal components of the antenna system of the present invention.

As shown in the drawings for purposes of illustration, the present invention pertains to aircraft antenna systems, and specifically to antennas that are fully integrated into the aircraft, rather than protruding out from the aircraft in the form of blades or fins. Aircraft antennas in general are electrically small, in relation to the wavelengths of some of the radio signals that are transmitted or received. For example, in a very-high-frequency frequency-modulated (VHF/FM) band of 30–88 MHz used for frequency-modulated (FM) transmission, the wavelengths are in the range of approximately 3–10 meters and typical blade antennas are much smaller than this. The antenna impedance has to be matched to that of the transmitter and receiver (usually 50 ohms), using impedance matching networks, but such antennas usually have a low gain. Another problem arises if there is a requirement for operation in a frequency-hopping mode. The matching networks have to be continually adjusted to new frequencies, using some form of active tuning device. However, such devices are notoriously costly and unreliable. Those with mechanical components would be unable to track rapid frequency changes for very long without being degraded or damaged.

In accordance with the present invention, a notch antenna is fully integrated into the aircraft, with no protruding components, and provides good performance characteristics over a wide range of frequency bands, without the need for active tuning devices. FIG. 1 shows the three principal components of the antenna system of the invention, including an antenna element 10, a multifunction VHF/UHF antenna feed 12, and antenna matching rf (radio-frequency) electronics 14, for coupling the antenna system to a VHF/UHF transceiver, indicated at 15.

Figure 2:
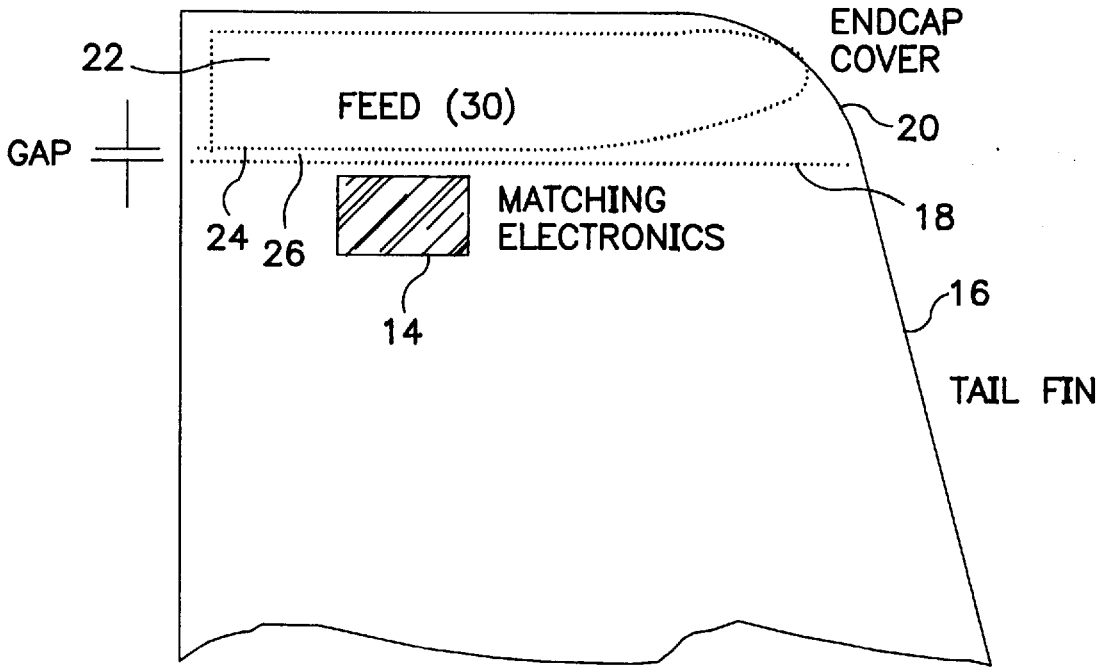
FIG. 2 is a simplified elevational view of a portion of an aircraft tail section, showing how the antenna of the invention is integrated into the aircraft structure.

FIG. 2 shows the structure of the antenna element 10 in relation to an aircraft tail fin, indicated by reference numeral 16. The tail fin 16 is part of the aircraft airframe and is electrically conductive. The fin 16 terminates at an upper edge 18 indicated by a horizontal line in the drawing. In the aircraft tail structure before the antenna was installed, the fin 16 was topped by an aerodynamically shaped endcap 20. In accordance with the invention, the endcap 20 encloses an antenna element 22 that cooperates with the tail fin 16 to form the notch antenna of the invention. The antenna element 22 is a generally planar component of irregular shape, having a lower edge 24 that is straight over a part of its length, and then curves upward away from the upper edge 18 of the tail fin 16. Other edges of the antenna element 22 generally follow the contours of the endcap 20. The gap between the upper edge 18 of the tail fin 16 and the lower edge 24 of the antenna element 22 defines a notch 26, the width of which is generally uniform over a small portion of the tail fin, and then flares or expands to a greater width over the remaining large portion of the tail fin.

In conventional notch antennas, the notch is typically excited at a feed point located approximately one-quarter wavelength ($\lambda/4$) from the narrow end of the notch. This is obviously not possible in an aircraft tail fin when the wavelength may be as large as ten meters. In the presently preferred embodiment of the invention, the feed point 30 is located at an optimum distance along the notch 26. The exact location of the antenna feed point 30 is critical to good performance, and is best determined experimentally for a specific aircraft configuration and wavelength. The matching electronics unit 14 is ideally located as close to the antenna feed point 30 as possible, and may be conveniently housed within the tail fin 16 as shown in FIG. 2. The specific design of the matching electronics 14 is determined by the measured impedance of the antenna 10 and the known input/output impedance specifications of the VHF/UHF transceiver 15 in FIG. 1. Although the antenna matching unit (AMU) can be designed to include discrete components, it is less costly and more convenient to integrate the electronics onto a single circuit board, in which inductors and capacitors may take the form of conductive traces on the board. Preferably, different matching networks are used for VHF and UHF operation of the antenna system. These are switched in and out as needed. Multiplexed operation of two or more frequency bands is also possible.

The VHF/UHF feed 12 (FIG. 1) i.e. the connection between the matching electronics 14 and the antenna element 10 (the components on each side of the notch 26), is best made by coaxial cable. At the feed point 30, very short connections are made from the coaxial cable to opposite sides of the notch 26 using a conductive wire to connect the coaxial cable inner conductor to the lower edge 24 and "grounding" the coaxial cable shield to the upper edge 18.

Figure 3:
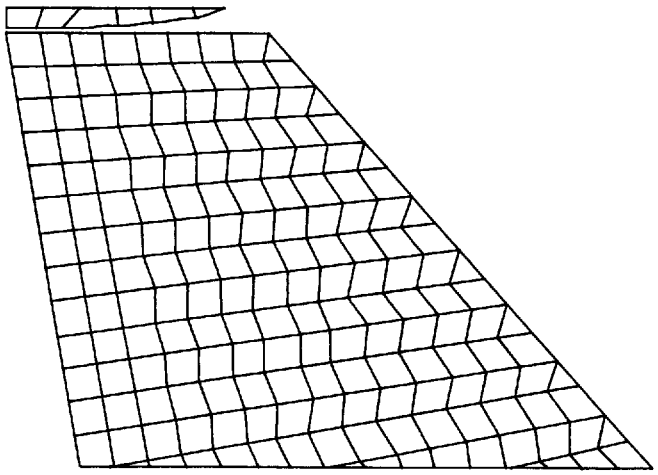
FIG. 3 is a diagrammatic view of a wire grid simulation model of the aircraft tail section.
Figure 4:
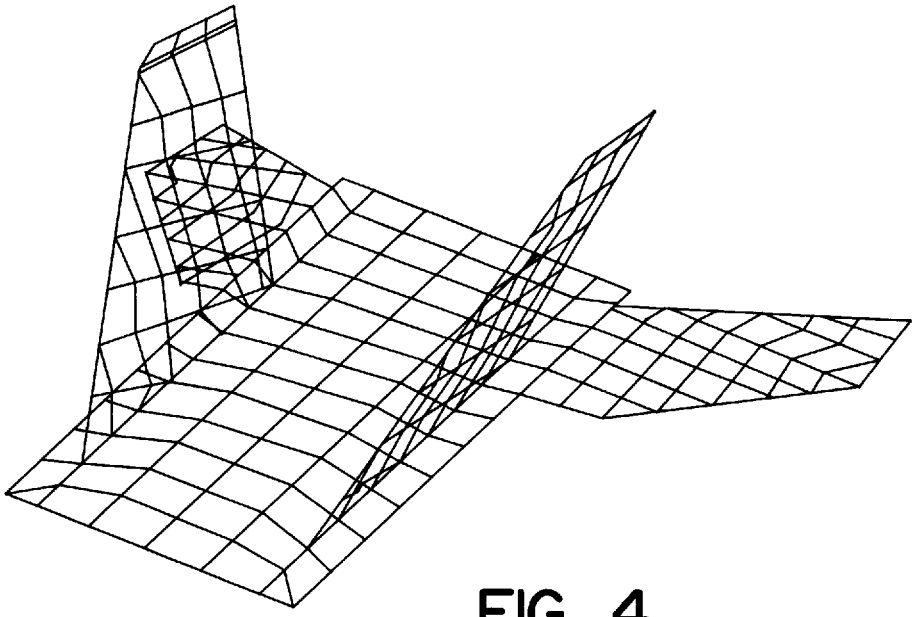
FIG. 4 is a diagrammatic view of a wire grid simulation model of full-sized test fixture in which the tail section of FIG. 3 is installed.

FIG. 3 shows a wire grid simulation model of a tail fin for an F-18 aircraft, with a single element endcap antenna. FIG. 4 shows a wire grid simulation model of a test fixture modeling the twin tail fin structure of the F-18. Using a well known numerical modeling technique referred to as the method of moments, the wire grid model is used to provide computer-generated theoretical feed points impedance and radiation pattern for comparison with experimental measurements. In the experimental test fixture, structural excitation was confirmed experimentally, using a small magnetic loop to probe rf (radio frequency) currents in various areas of the structure. Current was measured flowing along the leading edge of the tail and over its composite surfaces. In operation, the notch 26 (FIG. 2) radiates generally omnidirectionally, and both the antenna element 22 and the tail section 16 radiate as a result of the currents flowing in these components, in adjoining airframe components and in the composite conductive skin material over the airframe. Another critical factor in the antenna design is the width of the notch 26, i.e., the spacing between the antenna element 22 and the tail section 16 in FIG. 2. If this spacing is too small, the feed point admittance will be adversely affected by excessive capacitive susceptance. Although method of moments simulation can be used to select the notch width, the presently preferred approach is to select the notch width experimentally using a full-scale test fixture of a specific aircraft.

Figure 5:
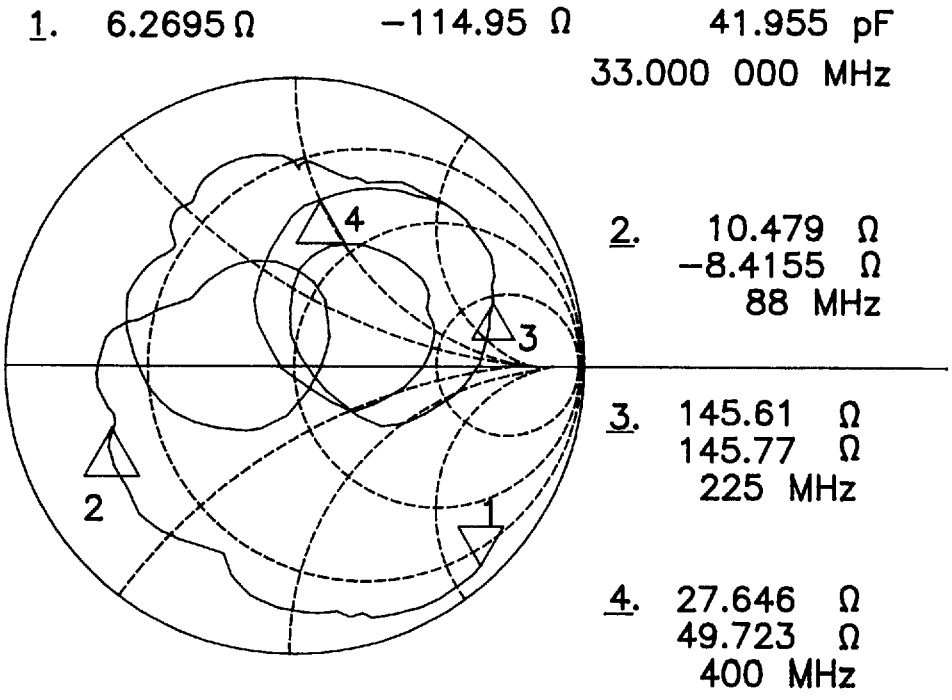
FIG. 5 is a simplified Smith Chart plotting the measured impedance of a VHF/FM antenna in accordance with the invention, as the frequency is varied.

FIG. 5 is a Smith Chart showing the measured antenna impedance from 30 to 400 MHz. The irregular curve in the chart plots the normalized complex impedance versus frequency. Marker 1 on the chart gives the complex impedance as approximately $(6.3-j115)\Omega$ at 33 MHz and Marker 2 on the chart gives the complex impedance as approximately $(10.5-j8.4)\Omega$ at 88 MHz. A Smith Chart plots complex impedance and admittance. A resistive impedance normalized to a characteristic impedance $Z_0$ ($R/Z_0=1$) is plotted at the center of the chart. Reactive impedances ($R/Z_0=0$) are plotted around the circumference of the chart. Impedances that are represented toward the center of the Smith Chart correspond to lower values of reflected power and lower values of voltage standing wave ratio (VSWR) for the antenna. A low VSWR value is desirable because it indicates good impedance matching and efficient transfer of energy to the antenna. A conventional notch antenna, of uniform notch width, has a relatively high reactive impedance over a large frequency range. A plot of the impedance locus would result in a curve close to the circumference of the chart, having a high VSWR and spanning a large range of impedance values over the VHF/FM band of 33–88 MHz. Such an antenna is difficult or impossible to match efficiently over the entire frequency range. In the present invention, the flared shape of the antenna notch 26 significantly reduces the span of impedance values and VSWR over the frequency range of interest, and renders the antenna much easier to broadband impedance match over the frequency range.

As can be seen from the further plot of impedance values, as the frequency is increased above the VHF/FM band, the complex impedance in general moves closer to the center of the chart, and is correspondingly easier to match with transceiver equipment. At marker 3, the impedance is approximately (145.6+j145.8)Ω at 225 MHz, and at marker 4 the impedance is approximately (27.6+j49.7)Ω at 400 MHz. In this chart, 1=50 ohms.

Figure 6A:
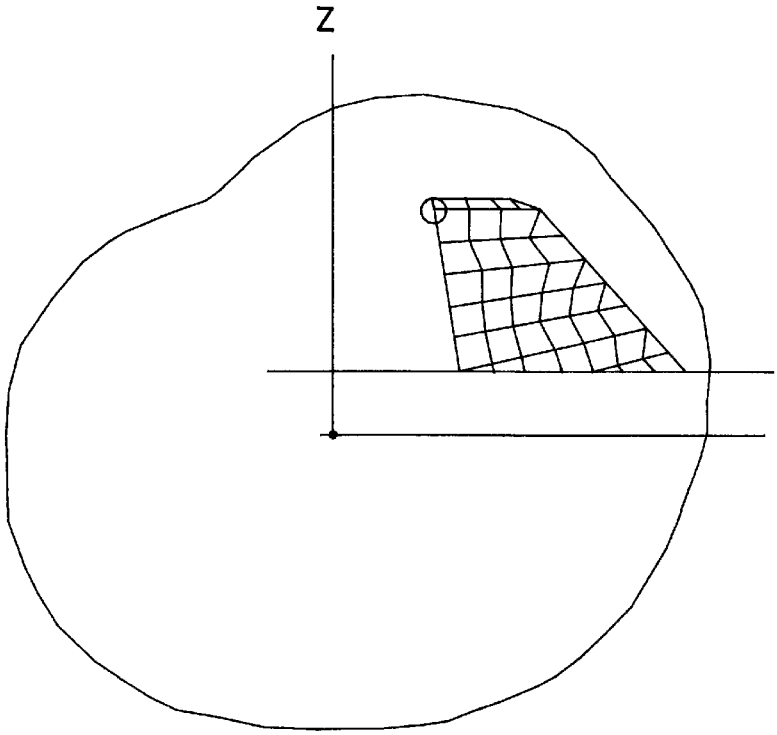
FIGS. 6A and 6B are predicted radiation patterns for the antenna of the invention, for variations in elevation and azimuth, respectively.
Figure 6B:
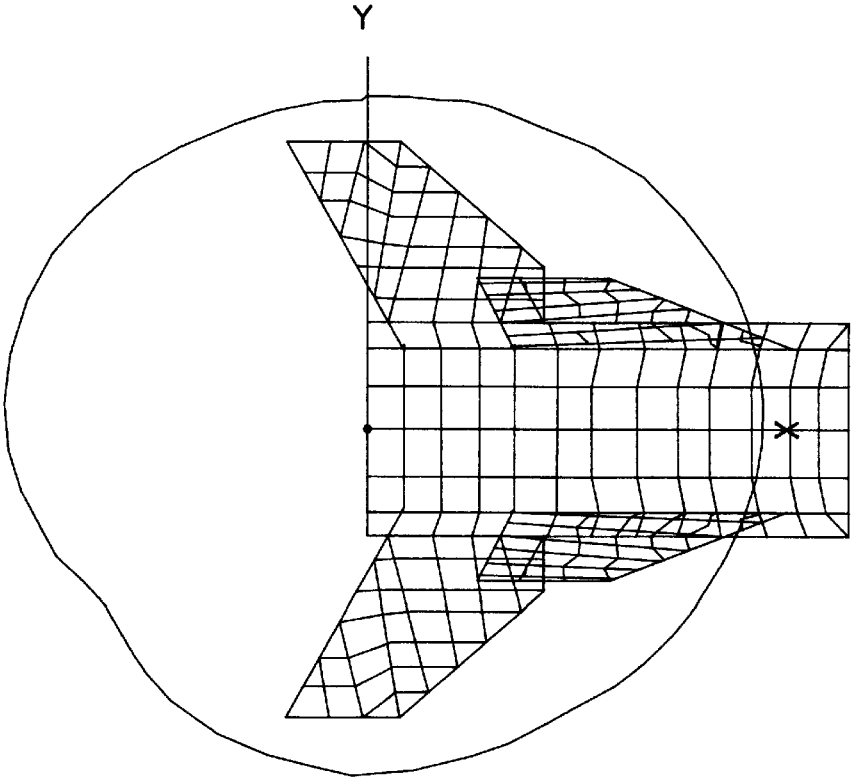

FIGS. 6A and 6B show predicted radiation patterns in free space for the VHF/FM antenna mounted in the test fixture of FIG. 4. FIG. 6A shows the radiation pattern with respect to variations in elevation angle and FIG. 6B shows the radiation pattern with respect to variations in azimuth angle. Both patterns are for a 30 MHz signal and vertical polarization. If several dB (decibels) are subtracted to allow for losses in the matching network, the predicted gain is still estimated to be approaching zero dBi and is significantly better than a blade antenna. It will also be observed that the radiation pattern is substantially omnidirectional, in both azimuth and elevation. The radiation patterns will, of course, be different with the actual aircraft.

Because of its nearly omnidirectional characteristics, the antenna of the invention does not necessarily have to be mounted in the orientation shown in the drawings. The antenna notch 26 (FIG. 2) was flared toward the forward end of the aircraft for convenience, but would operate with similar results if the notch were to be flared toward the aft end of the aircraft. Similarly, the antenna could, alternatively, be mounted in a horizontal member of the aircraft structure, such as a wing or horizontal stabilizer, or in any other convenient structural component of the aircraft.

Two similar antenna systems constructed in accordance with the present invention may be installed on an aircraft, such as on the twin tail sections of an F-18 aircraft, either to provide a backup antenna system, or to provide a beam steering or direction finding function. By controlling the relative phase of the two antennas, one can form the beam to have a maximum in its radiation pattern in a desired direction, or to have a minimum in a desired direction. The principles of beam steering using antenna arrays are well known and may be conveniently adapted to systems with two or more antennas constructed in accordance with the present invention.

Figure 7:
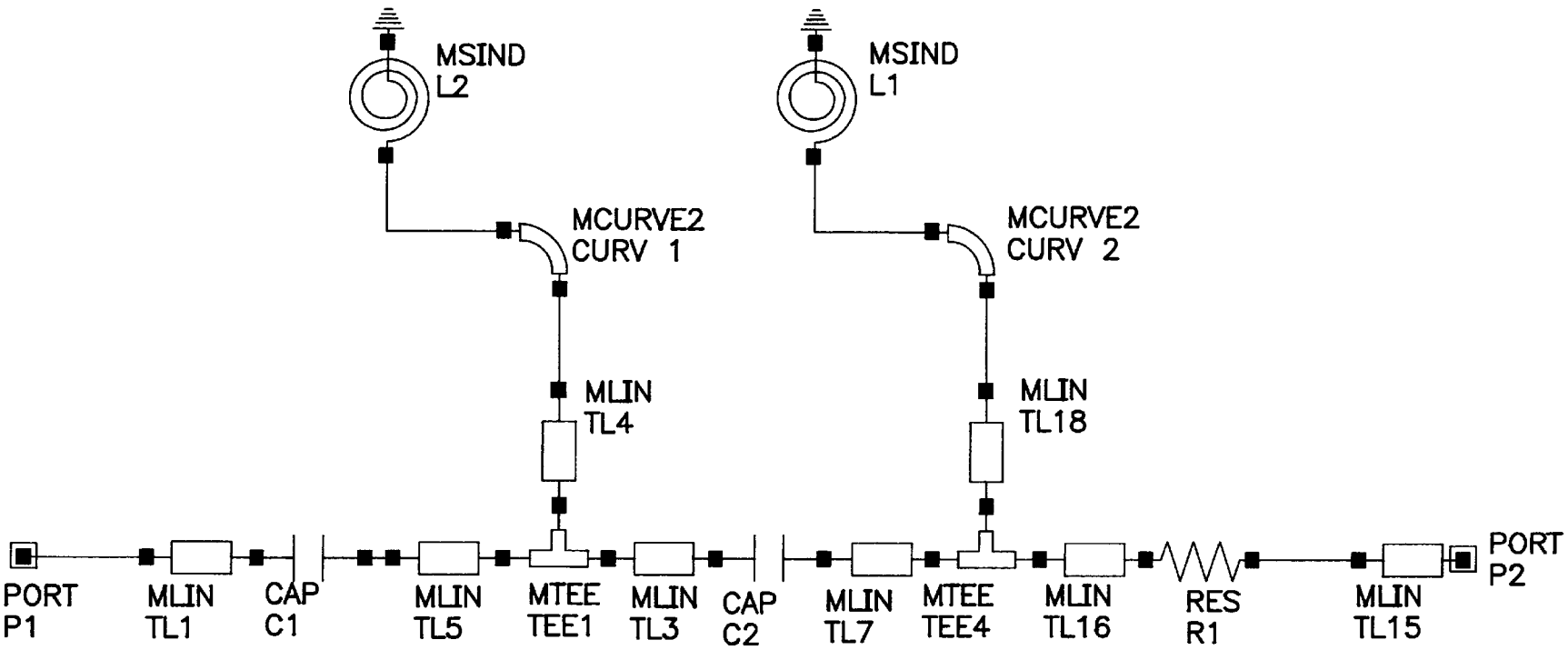
FIG. 7 is schematic diagram of antenna matching rf (radio frequency) electronics used in one embodiment of the invention.

FIG. 7 provides by way of illustration schematic details of the antenna broadband matching rf electronics 14 (FIG. 1) used in a preferred embodiment of the invention. The figure is a reproduction of one produced by circuit simulation software, such as "EEsof," a product of the Hewlett-Packard Company, Palo Alto, Calif. For convenience of illustration, the component identification information is printed on the schematic. The nomenclature is largely self-explanatory. The "input" port P1 connects the matching network to the radio transceiver.

The AMU circuitry includes various electrical components connected between two ports, designated P1 and P2. Port P1 is connected through a microstrip linear (MLIN) connector referred to as TL1, to a first capacitor C1, and from there through another linear connector TL5 to a microstrip tee (MTEE) referred to as TEE1. The opposite port of TEE1 is connected through another linear connector TL3 to one terminal of a second capacitor C2. The other terminal of the capacitor C2 is connected in series to a linear connector TL7, another tee TEE4, another connector TL16, a resistor (RES) designated R1, and finally another connector TL15, which is connected to the second port P2. The "output" port P2 connects the matching network to the antenna.

The first tee TEE1 is also connected to a series network comprising a connector TL4, a curved microstrip connector CURV1 and a microstrip inductor (MSIND), designated L2, one terminal of which is grounded to the substrate ground. Similarly, the other microstrip tee TEE4 is also connected to a series network comprising a connector TL18, a curved microstrip connector CURV2 and a microstrip inductor (MSIND), designated L1, one terminal of which is grounded to the substrate ground.

It will be understood that the antenna matching unit (AMU) circuitry in FIG. 7 is shown by way of example only.

Figure 8:
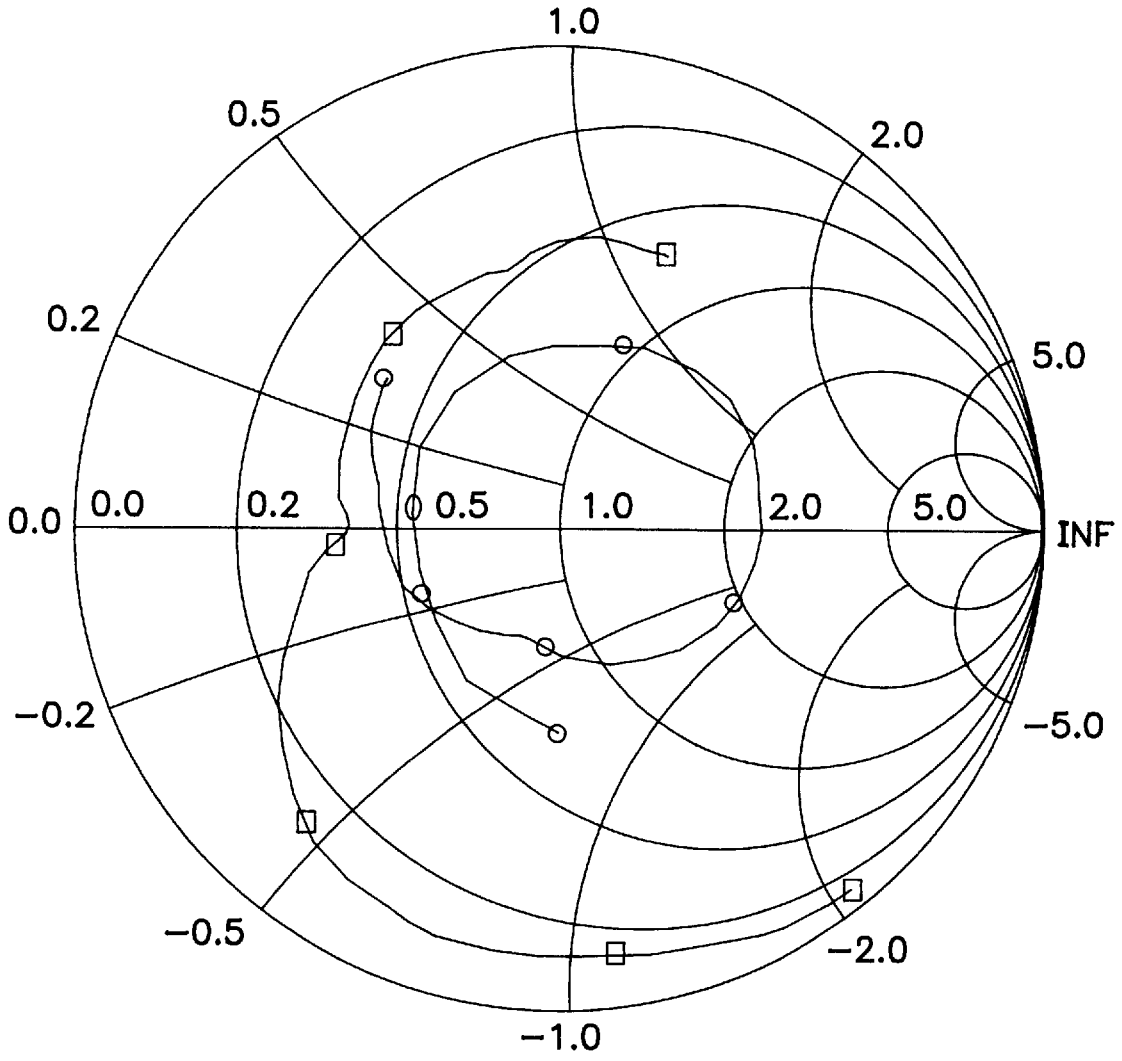
FIG. 8 is a Smith Chart plotting the antenna impedance with and without an antenna matching unit.

FIG. 8 is a Smith Chart showing the End Cap Antenna impedance with and without the AMU (antenna matching unit) in the 30 to 90 MHz VHF/FM frequency band.

Figure 9:
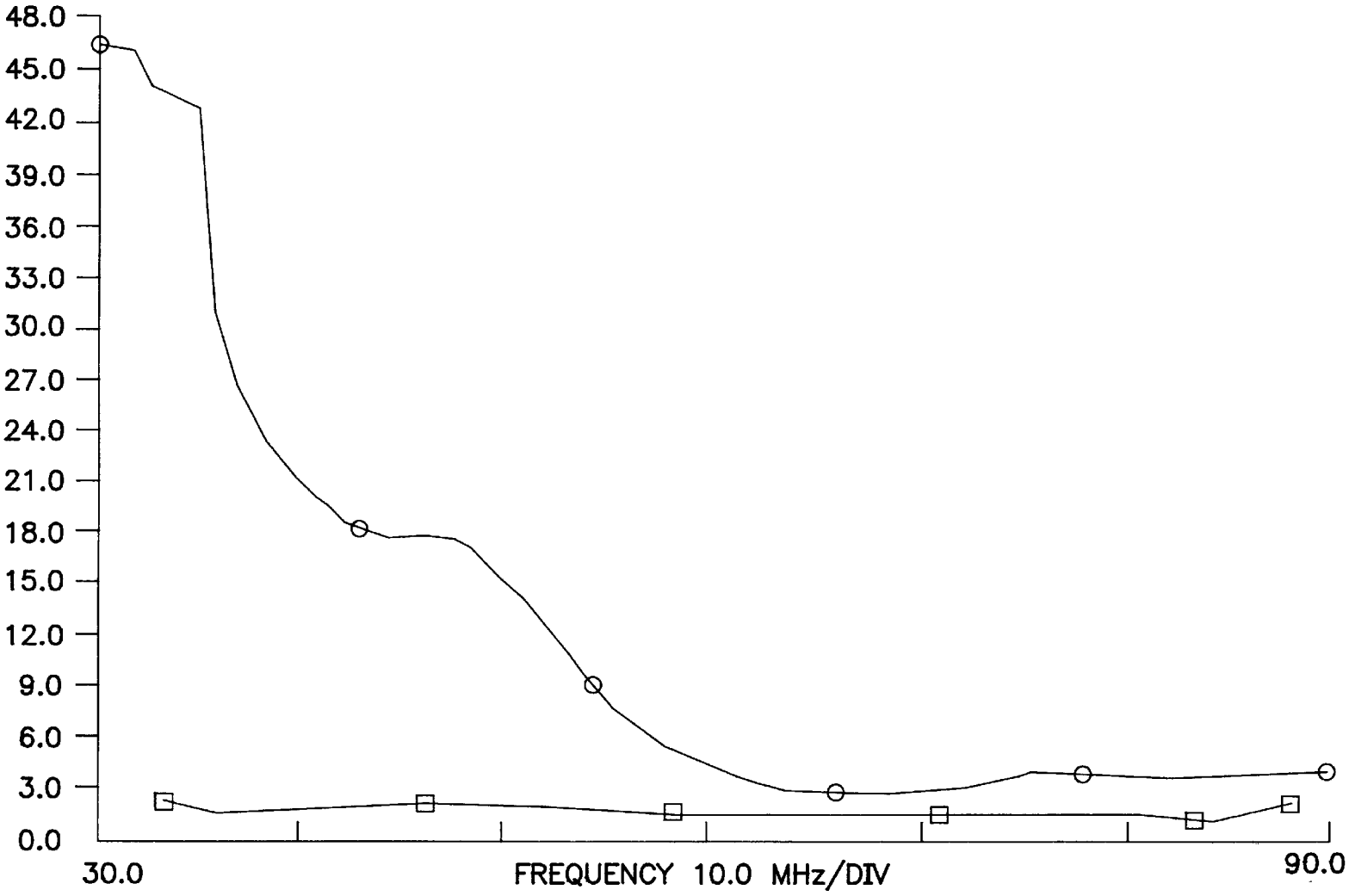
FIG. 9 shows the antenna VSWR (voltage standing wave ratio), with and without the antenna matching unit.

FIG. 9 shows the End Cap Antenna VSWR with and without the AMU (antenna matching unit) in the 30 to 90 MHz VHF/FM frequency band. With the AMU inserted the VSWR is less than 3 over the entire frequency band, indicating a very good broadband impedance match. Without the AMU, the VSWR is greater than 45 at 30 MHz and excess 3 over 50% of the frequency band.

It will be appreciated from the foregoing that the present invention represents a significant advance in the field of antenna design for aircraft. In particular, because the antenna of the invention is structurally integrated with the aircraft, the latter functions as an extension of the antenna and, at certain frequencies, this coupling of energy to the aircraft greatly increases radiation efficiency and gain, as compared to blade antenna designs. Full VHF/FM coverage can be provided without the need for an active tuner. Moreover, structural integration of the antenna element into the aircraft provides an antenna system that has a relatively low cost and is strong enough to withstand vibration in the environment of a tail fin endcap. Finally, the integrated antenna has no affect on the aerodynamics of the aircraft.

Although the invention has been described in the context of a military aircraft, it will also be appreciated that the antenna system of the invention also has application to commercial aircraft that need VHF/FM, VHF/AM and UHF communications. It will also be appreciated that, although a specific embodiment of the invention has been described in detail for purposes of illustration, the disclosed embodiment may be modified without departing from the spirit and scope of the invention. Accordingly, the invention should not be limited except as by the appended claims.

We claim:

1. An aircraft antenna system structurally integrated into an aircraft, for operation over a wide range of frequencies without the need for an active tuner, the antenna system comprising:

an electrically conductive portion of an aircraft structure;

an antenna element positioned and shaped to form a non-conductive notch between the antenna element and the electrically conductive portion of the aircraft structure, wherein the notch is generally uniform in width over part of its length and flares to a larger width over the remainder of its length;

matching electronics, for coupling the antenna system to a transceiver, and for broadband matching the impedance of the antenna system with the impedance of the transceiver to provide efficient transfer of energy to and from the antenna; and an antenna feed for connection from the matching electronics to opposite sides of the notch at a selected antenna feed point, to excite the antenna for transmission of signals and to conduct received signals from the antenna element and electrically conductive portion of the aircraft structure;

wherein the electrically conductive portion of the aircraft structure functions as a radiating and receiving component of the antenna system, which can be easily impedance matched with transceiver equipment operating over a wide range of frequencies.

2. An aircraft antenna system as defined in claim 1, wherein:

the electrically conductive portion of the aircraft structure includes a tail fin of the aircraft; and the antenna element is housed within a tail fin endcap.

3. An aircraft antenna system as defined in claim 2, wherein:

the antenna system operates at a very-high-frequency (VHF/FM) band in the range of approximately 30–88 MHz, as well as at higher frequencies in an ultra-high-frequency (UHF) band and in a very-high-frequency (VHF/AM) band, without the need for active tuner components.

4. An aircraft antenna system structurally integrated into an aircraft, for operation over a wide range of frequencies without the need for an active tuner, the antenna system comprising:

at least two electrically conductive portions of an aircraft structure;

at least two antenna elements positioned and shaped to form a non-conductive notch between each of the antenna elements and a corresponding electrically conductive portion of the aircraft structure, wherein each notch is generally uniform in width over part of its length and flares to a larger width over the remainder of its length;

broadband matching electronics, for coupling the antenna system to a transceiver, and for matching the impedance of the antenna system with the impedance of the transceiver to provide efficient transfer of energy to and from the antenna; and at least two antenna feeds for connection from the matching electronics to opposite sides of each notch at selected antenna feed points, to excite the antenna for transmission of signals and to conduct received signals from the antenna element and electrically conductive portion of the aircraft structure;

wherein the electrically conductive portions of the aircraft structure function as radiating and receiving components of the antenna system, which can be easily impedance matched with transceiver equipment operating over a wide range of frequencies;

and where the antenna elements and their associated electrically conductive portions of the aircraft structure are capable of directing a beam in a desired direction.

5. An aircraft antenna system as defined in claim 4, wherein:

the electrically conductive portions of the aircraft structure includes multiple tail fins of the aircraft; and each antenna element is housed within a tail fin endcap.

6. An aircraft antenna system as defined in claim 5, wherein:

the antenna system operates at a very-high-frequency (VHF) band in the range of approximately 30–88 MHz, as well as at high frequencies in an ultrahigh-frequency (UHF) band and a very-high-frequency (VHF/AM) band in the range of approximately 116–156 MHz, without the need for active tuner components.

* * * * *